United States Patent [19]

Komiyama et al.

[11] 4,055,417

[45] Oct. 25, 1977

[54] HYPER-EUTECTIC ALUMINUM-SILICON BASED ALLOYS FOR CASTINGS

[75] Inventors: Yoshiro Komiyama; Kunihiko Uchida, both of Okazaki; Masaaki Tokui, Toyota, all of Japan

[73] Assignee: Toyota Jidosha Kogyo Kabushiki Kaisha, Japan

[21] Appl. No.: 690,658

[22] Filed: May 27, 1976

Related U.S. Application Data

[63] Continuation-in-part of Ser. No. 557,096, March 10, 1975, abandoned.

[30] Foreign Application Priority Data

Mar. 13, 1974 Japan ..... 49-28938

[51] Int. Cl.[2] ..... C22C 21/04

[52] U.S. Cl. ..... 75/142; 75/143

[58] Field of Search ..... 75/142, 143

[56] References Cited

U.S. PATENT DOCUMENTS

| | | | |
|---|---|---|---|
| 2,076,578 | 4/1937 | Kempf et al. | 75/147 |
| 2,357,450 | 9/1944 | Bonsack | 75/142 |
| 2,357,451 | 9/1944 | Bonsack | 75/142 |
| 3,716,355 | 2/1973 | Wikle et al. | 75/142 |
| 3,765,877 | 10/1973 | Sperry et al. | 75/142 |

*Primary Examiner*—W. Stallard

*Attorney, Agent, or Firm*—Stevens, Davis, Miller & Mosher

[57] ABSTRACT

A hyper-eutectic aluminum-silicon based alloy for castings has an essential disadvantage in its poor strength. The present invention provides an alloy comprised of 16–25% Si, 3.0–5.5% Cu, 0.2–0.8% Mg, 0.3–0.8 Mn, not more than 0.25% Ti and not more than 0.3% Fe to remove the above mentioned disadvantage. Another provided alloy containing 0.5–1.5% Zn in addition to the above mentioned ingredients not only removes the above mentioned disadvantage but also improves machinability. A still further provided alloy containing 0.3–2.0% Pb in addition to the first mentioned ingredients not only removes the above essential disadvantage but also improves machinability as well as additionally enhancing the wear resistance. In the disclosed alloys the content of iron as one of the impurities is restricted to a low level, because iron destroys the effect of the invention to remove said disadvantage.

6 Claims, 8 Drawing Figures

HYPER-EUTECTIC ALUMINUM-SILICON BASED ALLOYS FOR CASTINGS

Figure 1:
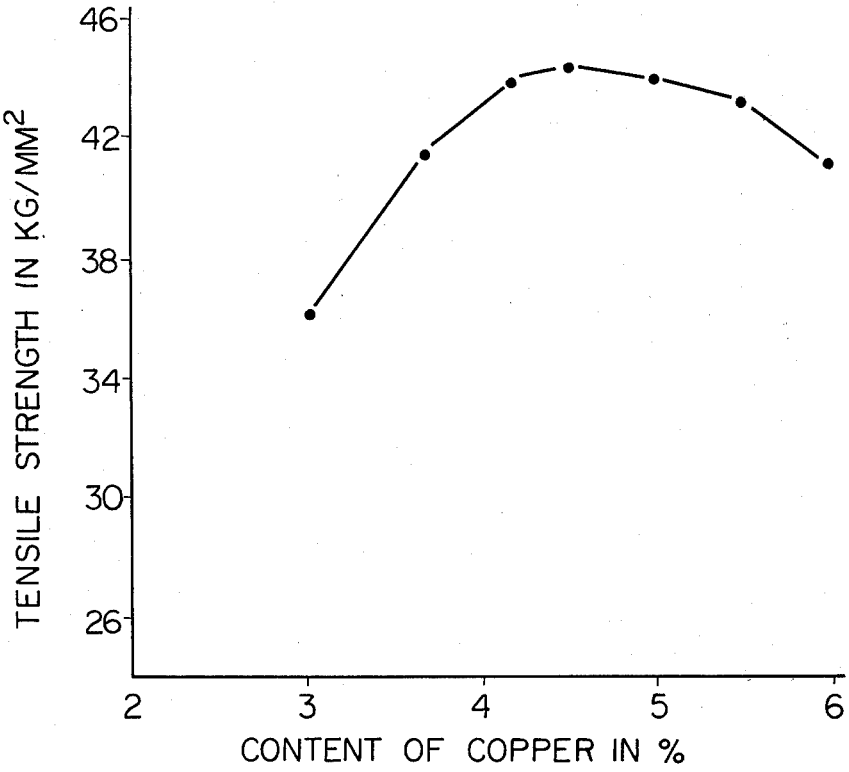

This application is a continuation-in-part application of the patent application Ser. No. 557,096 filed Mar. 10, 1975, now abandoned.

The present invention relates to a hyper-eutectic aluminum-silicon based, high strength alloy for castings.

It is known that hyper-eutectic aluminum-silicon alloys advantageously possess a low thermal expansion coefficient and an excellent wear-resistance due to the fact that these alloys contain considerably higher amounts of silicon than alloys of hyper-eutectic or eutectic composition. It is also known that hyper-eutectic aluminum-silicon based alloys possess a very low strength which results in said alloys being utilized only in limited fields. Various types of hyper-eutectic aluminum-silicon based alloys have been developed to meet the recent tendency in industries of using said alloys for such as the pistons or cylinder-heads of internal combustion engines. The developed alloys, however, exhibit a low tensile strength equal to approximately 30 $Kg/mm^2$, although they maintain both thermal expansion and wear resistant properties, which are the characteristic of the hyper-eutectic aluminum-silicon based alloys.

The U.S. Pat. No. 2,357,451, issued to Bonsack, discloses an aluminum alloy containing 18 to 35% silicon, about 0.1 to 1% magnesium, about 1 to 5% copper, about 0.4 to 2% iron, about 0.1 to 3% tin, about 0.3 to 3% zinc, and at least one of the hardening metals such as manganese in a total amount of about 3% or less, and at least one of the hardening and grain refining metals such as titanium, in a total amount of 2% or less. The U.S. Pat. No. 2,357,452, issued to Bonsack, discloses an aluminum alloy, which is similar to the above mentioned U.S. Pat. No. 2,357,451 and includes about 0.3 to 4% copper, about 0.3 to 4% zinc, 5% or less of a hardening metal such as manganese, without utilizing tin. Although the alloys disclosed in these United States Patents possess a low thermal expansion, the tensile strength of the alloys is considerably low.

It is, therefore, an object of the present invention to provide hyper-eutectic aluminum-silicon based alloys for castings, which alloys possess an extremely high tensile strength at a room temperature amounting to 35 $Kg/mm^2$ or more, in addition to the low thermal expansion coefficient and the high wear resistant property.

It is another object of the present invention to provide hyper-eutectic aluminum-silicon based alloys for castings which possess excellent strength at elevated temperature so that they can be used as high temperature alloys.

It is a further object of the present invention to provide hyper-eutectic aluminum-silicon based alloys for castings having an excellent machinability.

Further objects of the present invention will be apparent from the descriptions of the embodiments presented hereinafter.

In accordance with these and other objects there is provided a hyper-eutectic aluminum-silicon based alloy for castings, consisting essentially of 16 to 25% of silicon, 3.0 to 5.5% of copper, 0.2 to 0.8% of magnesium, 0.3 to 0.8% of manganese, not more than 0.25% of titanium, and not more than 0.3% of iron the balance being aluminum. All percents used herein are percents by weight.

Silicon present in the proposed aluminum alloys increases the wear resistance and the hardness and, further, lowers the thermal coefficient of said alloys.

In order to produce a hyper-eutectic aluminum-silicon based alloy, it is generally sufficient that the lower critical content of silicon be 12%. In alloys containing from 12 to below 15% of silicon, however, only a small amount of primary silicon crystals precipitate because the compositions of such alloys are close to the eutectic. In this case, none of the wear resistant, heat resistant and thermal expansion properties desired in the present invention are obtainable. In order to ensure these properties, the lower critical content of silicon should preferably be 16%. With an increase in the silicon content to more than 19%, particularly more than 25% the strength lowers and the machinability deteriorates and, in addition, it becomes difficult to improve the microscopic structure by addition of another element and also to effect advantageous casting operations. Accordingly, the alloy according to the present invention contains from 16 to 25%, preferably 16 to 19%, of silicon.

Copper present in the proposed aluminum-silicon based alloy provides the heat-treatable property to this alloy and thus exercises a great effect on enhancement of both strength and hardness by the heat treatment.

FIG. 1 shows the dependence of the tensile strength in $Kg/mm^2$ upon the content of copper contained in an alloy, which essentially consists of 3.7, 4.3, 4.5, 5.0, 5.5 or 6.0% of copper, 17% of silicon, 0.5% of magnesium, 0.5% of manganese and the balance of aluminum, and which alloy is subjected to a solution treatment at a temperature of 510° C and, subsequently, ageing at a temperature of 170° C. As is clear from FIG. 1, the tensile strength increases with an increase in the content of copper, and reaches the maximum value at a copper content of from 4.0 to 5.0%. Accordingly, in order to obtain the desired level of tensile strength, the alloy according to the present invention should contain copper in an amount of from 3.0 to 5.5%, preferably 4.0 to 5.0%.

Magnesium present in the proposed aluminum-silicon based alloy exercises the same effect on this alloy as the copper does. Namely, the magnesium greatly influences the age-hardening of the proposed alloy and thus enhances the strength and hardness thereof.

Figure 2:
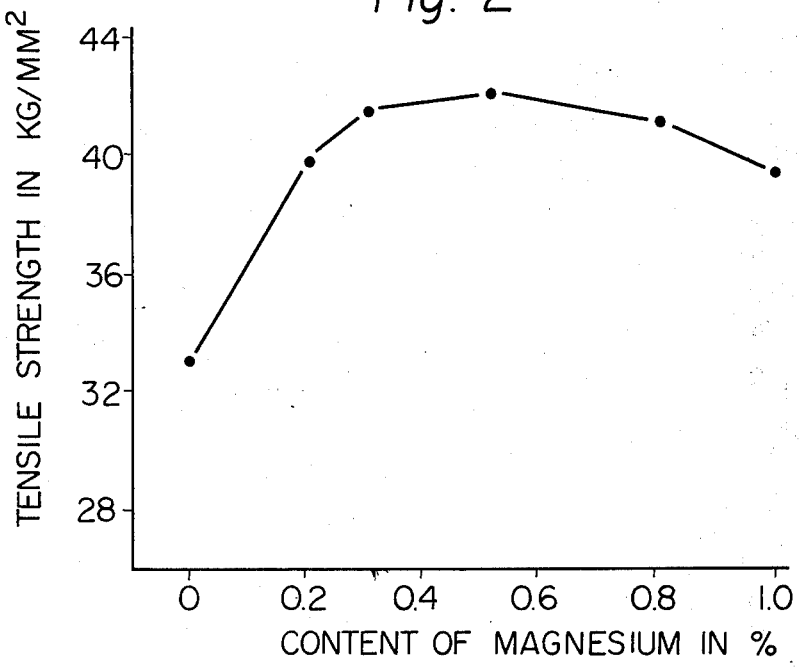

FIG. 2 shows the dependence of the tensile strength in $Kg/mm^2$ upon the content of magnesium contained in an alloy, which essentially consists of about 0.2, 0.3, 0.5, 0.8 or 1.0% of magnesium, 17% of silicon, 4.2% of copper, 0.5% of manganese and the balance of aluminum, and which alloy is subjected to a solution treatment at a temperature of 510° C and, subsequently, to ageing at a temperature of 170° C. As is clear from FIG. 2, the tensile strength increases with an increase in the content of magnesium and reaches the maximum value at a magnesium content of 0.3 to 0.5%. In order to obtain the desired tensile strength level, the alloy should contain magnesium in an amount of from 0.2 to 0.8%.

Manganese present in the proposed alloy is compulsorily solutioned in the aluminum matrix and then forms a thermally stable super-saturated solid solution. The manganese, therefore, exercises advantageous effects on enhancement of both strength and hardness at elevated temperatures. In addition, the manganese enhances the strength and the hardness at room temperature.

Figure 3:
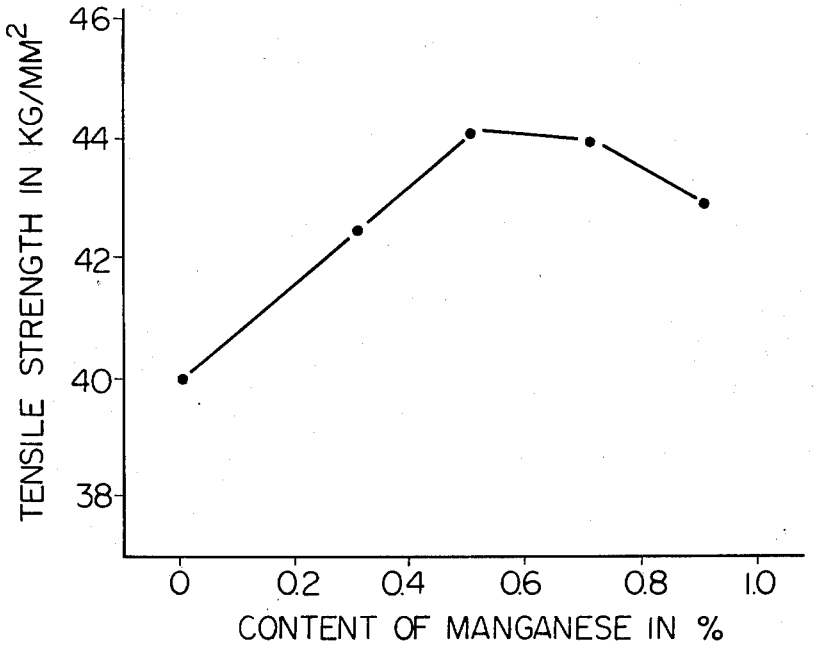

FIG. 3 shows the dependence of the tensile strength in Kg/mm² upon the content of manganese contained in an alloy, which essentially consists of about 0.3, 0.5, 0.7 or 0.9% of manganese, 17% of silicon, 4.2% of copper, 0.5% of magnesium and the balance of aluminum, and which alloy is subjected to a solution treatment at a temperature of 510° C and, subsequently, to ageing at a temperature of 170° C. The following facts are apparent from FIG. 3. The tensile strength increases with an increase in the manganese content and reaches the maximum values amounting to from 42.5 to 44 Kg/mm² at a manganese content of from about 0.3 to about 0.5%. The tensile strength gradually lowers with an increase in the manganese content higher than 0.5%, and steeply lowers at a manganese content higher than 0.8%. This steep descent is believed to be the result of formation of a manganese compound. The manganese present in the proposed alloy, therefore, enhances the tensile strength at room temperature, which results from the fact that the manganese is solutioned in the aluminum matrix and thus strengthens it, if the alloy contains manganese in an amount of from 0.3 to 0.8%, preferably from 0.3 to 0.5%. In addition to enhancing the strength both at room temperature and elevated temperature, the manganese present in the proposed alloy mitigates the unfavorable effects of iron and improves the fluidity, thereby obtaining good castability.

Titanium is contained in the proposed alloy for the purpose of grain-refinement. The alloy, therefore, should contain titanium in a minute amount, i.e. not more than 0.25%, and preferably from 0.1 to 0.25%. The titanium added in excess of 0.25% unfavorably forms titanium compounds with some other ingredients of the alloy.

The herein proposed alloys may contain conventional impurities. Since iron, i.e. one of the conventional impurities, especially exerts unfavorable influences upon the mechanical properties of aluminum-silicon based alloys. It is, therefore, necessary to reduce the content of iron in such alloys to low level or to produce the alloys free from the iron.

Figure 4:
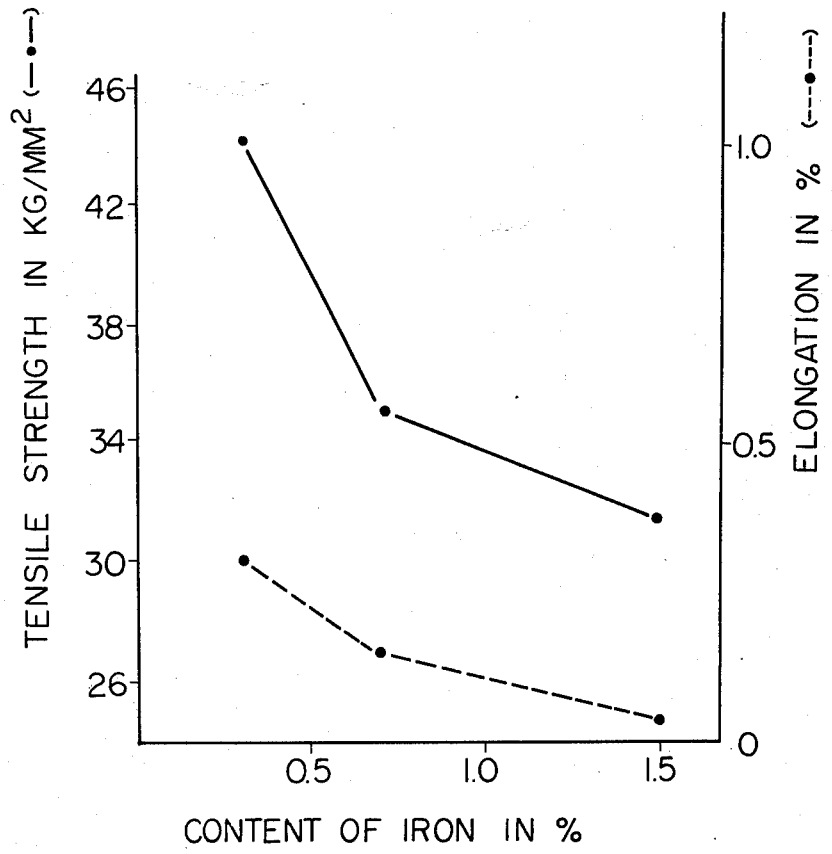

FIG. 4 shows the dependence of the tensile strength in Kg/mm² and the elongation in % upon the content of iron in an alloy, which essentially consists of 17% of silicon, 4.2% of copper, 0.5% of magnesium, 0.15% of titanium, 0.3, 0.7 or 1.5% of iron, and the balance of aluminum, and which alloy is subjected to a solution treatment at a temperature of 510° C and, subsequently to ageing at a temperature of 170° C.

As seen in FIG. 4, the iron greatly reduces the tensile strength and the elongation of the alloy even when the iron is present in the alloy in a low content of 0.3 to 0.7%. However, since the manganese present in the alloy proposed according to the invention mitigates the adverse effects of iron, the tensile strength is higher than that of conventional alloys even when the proposed alloy contains up to 0.5% of iron. Nevertheless, the upper limit of iron should be 0.3% from a point of view achieving the high tensile strength and elongation, and avoiding an extreme decrease in the tensile strength caused by excess of 0.3% of iron.

The herein proposed aluminum-silicon based alloy is melted using conventional raw materials in a conventional melting furnace, for example, an induction furnace. When the ordinary raw materials are used, the adverse impurity, i.e. iron, does not exceed the upper limit of 0.3%. The melt is then preferably covered with fluxing materials or treated by a red phosphorus, and subsequently poured at a temperature of for example 800° C to 850° C into mold(s) having suitable size and shape for the final product. The produced aluminum casting is heated to a temperature of for example 500° C to 510° C to pass the various hardening ingredients into the solid solution and, then, quenched in water or other cooling media. The solutioned casting is then heated to a temperature of 160° C to 180° C to harden the alloy by precipitation-hardening.

The herein proposed hyper-eutectic aluminum-silicon based alloy can be used in such articles where the high strength and excellent wear resistant property as well as the low thermal expansion are required. Such articles include, for example, cylinder blocks and piston.

According to the first embodiment of the hyper-eutectic aluminum-silicon based casting alloy, it contains 0.5 to 1.5% of zinc in addition to the aforementioned ingredients. The alloy according to the first embodiment, therefore, essentially consists of 16 to 25%, preferably 16 to 19% of silicon, 3.0 to 5.5%, preferably 4.0 to 5.0% of copper, 0.2 to 0.8%, preferably 0.3 to 0.5% of magnesium, 0.3 to 0.8%, preferably 0.3 to 0.8% of manganese, not more than 0.25% of titanium, 0.5 to 1.5% of zinc, not more than 0.3% of iron, and the balance of aluminum. The zinc added to the alloy composed of the basic ingredients improves the strength and the elongation compared to the basic alloy, while the other excellent properties realized in the basic alloy can substantially be maintained at the same level. The zinc also contributes to the good machinability of the alloy of said embodiment.

Figure 5:
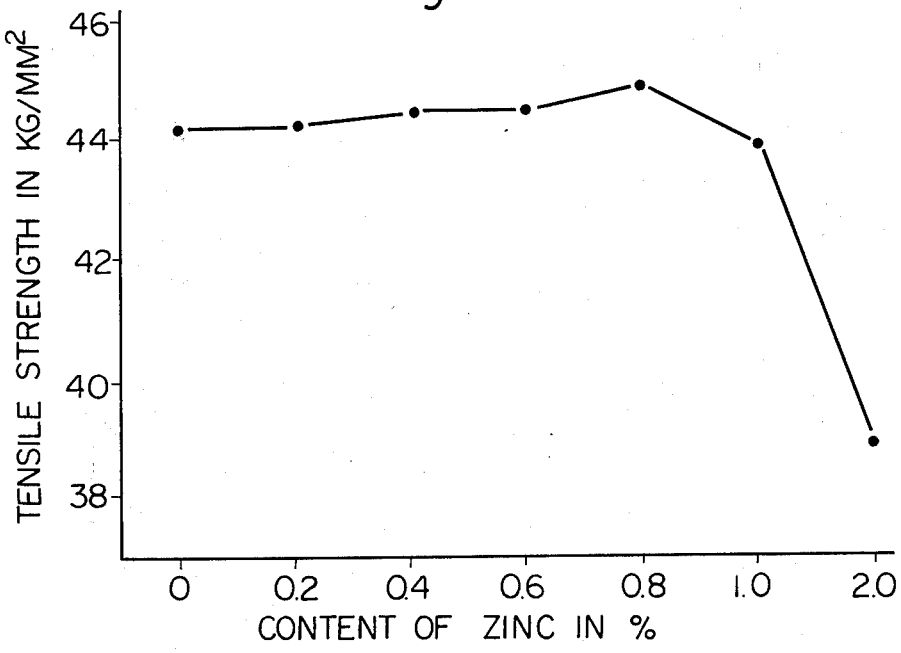

FIG. 5 shows the dependence of the tensile strength in Kg/mm² upon the content of zinc added in an amount of about 0.2, 0.4, 0.6, 0.8, 1.0 or 2.0 into an aluminum alloy comprised of 17% silicon, 4.2% copper, 0.5% magnesium, 0.5% manganese and 0.15% titanium, and which alloy is subjected to a solution treatment at a temperature of 510° C and, subsequently, ageing at a temperature of 170° C. As is clear from FIG. 5, the tensile strength gently increases with an increase in the content of zinc up to 1.0% of zinc and then steeply decreases.

If the alloy in the first embodiment contains the zinc in excess of 1.5%, the tensile strength considerably decreases as is clear in FIG. 5, although the elongation and the machinability are maintained at high levels due to the addition of zinc. In contrast, if the alloy contains zinc in an amount below 0.5%, the elongation and the machinability substantially remain at the same levels as those of the basic alloy. The proposed alloy in the first embodiment, therefore, contains zinc in an amount of from 0.5 to 1.5%. The proposed alloy should more preferably contain zinc in an amount of from 0.5 to 1.0% so as to satisfy the requirement for both high tensile strength and improved machinability.

According to the second embodiment of the hyper-eutectic aluminum-silicon based casting alloy, it contains 0.3 to 2.0% of lead in addition to the aforementioned basic ingredients. The alloy according to the second embodiment, therefore, essentially consists of 16 to 25%, preferably 16 to 19%, of silicon, 3.0 to 5.5%, preferably 4.0 to 5.0%, of copper, 0.2 to 0.8%, preferably 0.3 to 0.5%, of magnesium, 0.3 to 0.8%, preferably 0.3 to 0.5%, of manganese, not more than 0.25% of titanium, 0.3 to 2.0% of lead not more than 0.3% iron, and the balance of aluminum. The lead added to the alloy composed of the basic ingredients improves the wear resistance and machinability compared to the basic alloy. The improvement of wear resistance and machinability is attributed to the dispersion of lead-particles in the aluminum matrix, which is similar to the dispersion of the silicon primary crystals. If the added amount of lead is below 0.3% the meritorious effects will not be remarkable, while if the added amount is in excess of 2% the lead has a tendency to segregate in the alloy.

Figure 6:
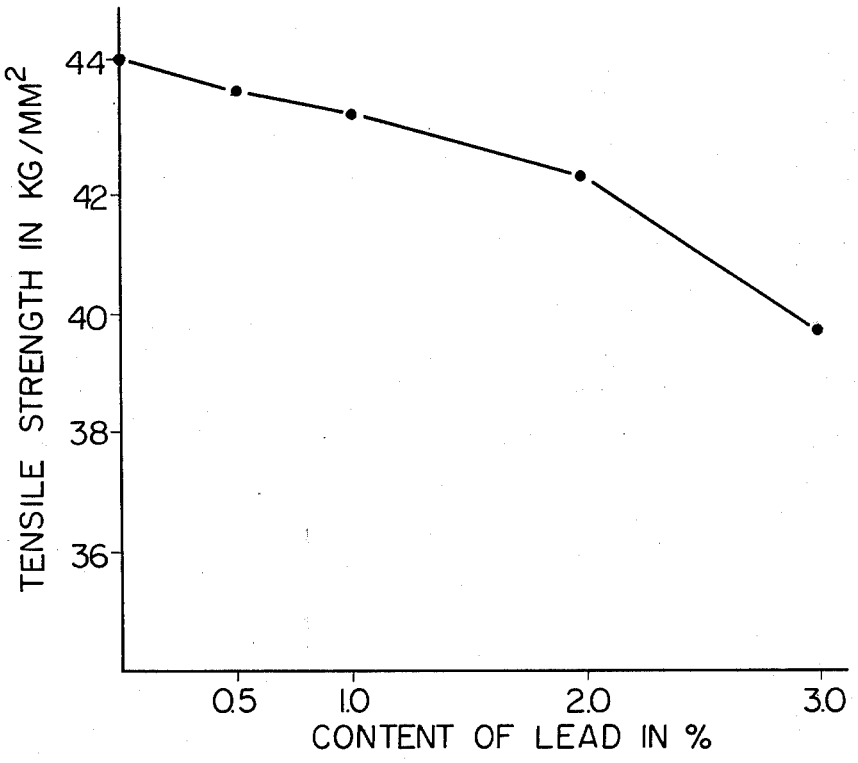

FIG. 6 shows the dependence of the tensile strength in Kg/mm² upon the content of lead added in an amount of about 0.5, 1.0, 2.0 and 3.0% into an aluminum alloy comprised of 17% silicon, 4.2% copper, 0.5% magnesium, 0.5% manganese, and 0.15% titanium, and which alloy is subjected to a solution treatment at a temperature of 510° C and, subsequently to ageing at a temperature of 170° C. As is clear from FIG. 6, the tensile strength gently decreases with an increase in the lead content up to 2.0% and, then steeply decreases with an increase in the lead content in excess of 2.0%.

Accordingly, the proposed alloy in the second embodiment should contain lead in an amount of from 0.3 to 2.0%, preferably 0.7 to 1.2%, in order to satisfy the requirements for both mechanical properties, i.e. tensile strength and wear resistance, and machinability.

The following example 1 is exemplary of the proposed alloys, and is illustrated in comparison with known, hyper-eutectic aluminum-silicon based alloys.

EXAMPLE 1

Starting mixtures of the proposed and known alloys, respectively, were melted in an induction furnace. A small amount of red phosphorous was added into the melt to refine the primary crystals of silicon. The melt was then poured at 800° C into a bilge-type, metallic mold shaped according to JIS standard, thereby obtaining a casting for a specimen. The casting was solution-treated at 510° C over a period of 6 hours and then water-quenched. The quenched casting was artificially aged at 170° C over a period of 7 hours. The casting was, then, machined into predetermined specimens and the chemical composition, mechanical properties, wear resistance, thermal expansion and tensile strength at high temperature were measured.

The chemical compositions of the alloys were as shown in Table I, below.

Table I

| | Sample No. | Si | Cu | Mg | Ni | Mn | Ti | Zn | Cr | Pb | Fe | Al |
|---|---|---|---|---|---|---|---|---|---|---|---|---|
| | | (Composition of Alloy) | | | | | | | | | | |
| | 1 | 17 | 4.2 | 0.5 | — | 0.5 | 0.15 | 0.01 | — | — | 0.3 | bal |
| | 2 | 19 | 4.5 | 0.5 | — | 0.5 | 0.15 | 0.01 | — | — | 0.2 | bal |
| | 3 | 19 | 4.0 | 0.5 | — | 0.3 | 0.15 | 0.5 | — | — | 0.2 | bal |
| In- | 4 | 19 | 5.0 | 0.5 | — | 0.5 | 0.15 | — | — | — | 0.3 | bal |

Table I-continued

| | Sample No. | Si | Cu | Mg | Ni | Mn | Ti | Zn | Cr | Pb | Fe | Al |
|---|---|---|---|---|---|---|---|---|---|---|---|---|
| | | (Composition of Alloy) | | | | | | | | | | |
| ven- | 5 | 24 | 4.0 | 0.5 | — | 0.5 | 0.15 | 0.8 | — | — | 0.2 | bal |
| tion | 6 | 24 | 5.0 | 0.5 | — | 0.5 | 0.15 | 0.01 | — | — | 0.3 | bal |
| | 7 | 20 | 4.4 | 0.5 | — | 0.5 | 0.15 | 0.1 | — | 1.5 | 0.2 | bal |
| | 8 | 18 | 1.2 | 1.1 | 2.0 | — | 0.15 | — | — | — | 0.2 | bal |
| Con- | 9 | 24 | 1.5 | 1.2 | 1.5 | — | 0.15 | — | — | 2.0 | 0.2 | bal |
| trol | 10 | 18 | 3.0 | 0.5 | 2.0 | — | 0.15 | 0.5 | — | — | 0.2 | bal |
| | 11 | 20 | 1.2 | 1.1 | 1.5 | — | 0.15 | — | 0.5 | — | 0.3 | bal |

The mechanical property and the thermal expansion of the alloys were as shown in Table II, below.

Table II

| | Sample No. | Tensile Strength (Kg/mm²) | Elongation (%) | Fatigue Strength (Kg/mm²) | Hardness (Hv) | Thermal Expansion Coefficient × 10⁶ |
|---|---|---|---|---|---|---|
| | | Mechanical Properties and Thermal Expansion Coefficient | | | | |
| | 1 | 44.0 | 0.3 | 12.6 | 150 | 20.2 |
| | 2 | 42.0 | 0.2 | 12.1 | 153 | 19.6 |
| | 3 | 43.0 | 0.8 | 12.0 | 148 | 19.5 |
| Invention | 4 | 43.0 | 0.2 | 11.9 | 150 | 19.4 |
| | 5 | 38.1 | 1.2 | 10.0 | 160 | 18.8 |
| | 6 | 36.0 | 0.2 | 9.6 | 165 | 18.9 |
| | 7 | 41.0 | 0.3 | 11.8 | 150 | 19.1 |
| | 8 | 26.0 | 0.3 | 10.5 | 145 | 19.9 |
| | 9 | 23.0 | 0.1 | 9.0 | 160 | 18.7 |
| Control | 10 | 28.0 | 0.2 | 10.8 | 148 | 20.0 |
| | 11 | 24.0 | 0.2 | 9.1 | 150 | 19.0 |

The specimens were subjected to an abrasion test using the Ogoshi-type testing machine wherein an aluminum-silicon based alloy designated as JIS-AC8A and containing nominally 11–13% of silicon, in addition to all of the specimen was subjected to abrasion by a specimen of gray cast iron designated as JIS-FC23.

The results of the abrasion tests are shown in Table III.

Table III

| | Sample No. | Relative Abrasion Amount |
|---|---|---|
| | Abrasion | |
| | 1 | 25.8 |
| | 2 | 23.2 |
| | 3 | 23.0 |
| Invention | 4 | 21.4 |
| | 5 | 18.3 |
| | 6 | 16.4 |
| | 7 | 17.5 |
| | 8 | 25.05 |
| | 9 | 16.8 |
| Control | 10 | 23.7 |
| | 11 | 21.5 |

Remarks: Relative abrasion amounts of the specimens are shown with respect to the abrasion amount of JIS-AC8A taken as 100.

As is clear from Table II, the specimens of the invention have approximately the same hardness as those of the conventional alloys; however, the strength, particularly the tensile strength, of the former, is considerably greater than that of the latter. This greater strength is believed to be the result of the fact that magnesium and a large amount of copper added to aluminum-silicon based alloy greatly improves the mechanical properties by heat-treatment and, further, that the adverse effects of iron are mitigated by incorporation of manganese. As is also clear from Table II, the thermal expansion coefficients of the specimens of the invention are as low as those of the conventional alloys.

It will be apparent from Table III that the specimens of the invention have approximately the same wear resistance property as the specimens of the conventional alloys. This good wear resistance is believed to be the result of the silicon precipitated as the primary crystal. Sample No. 7, which contains 1.5% Pb and has a relative low content of Si, has approximately the same wear resistance as Samples 6 and 7. This excellent wear resistance of Sample 7 is the result of the lead dispersion in the aluminum matrix. It is the inventors' belief that the other ingredients, i.e. Cu, Mg, Mn, Ti and Zn, do not contribute substantially to the enhancement of wear resistance.

Figure 7:
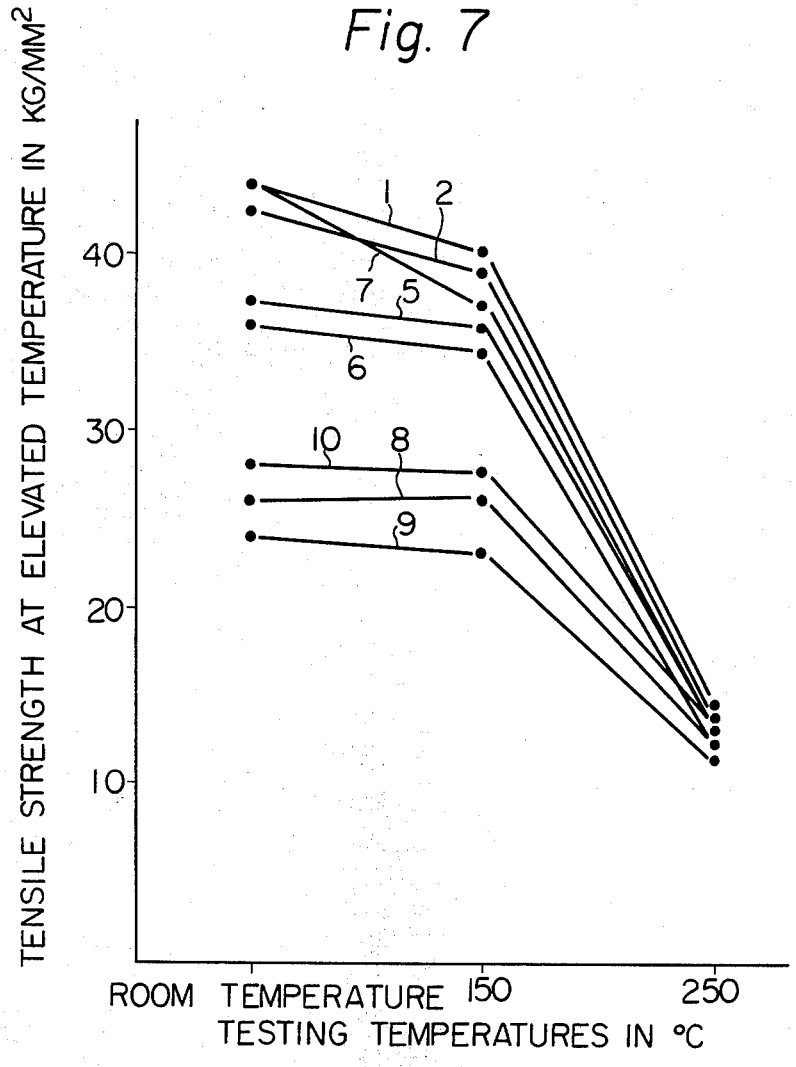

Samples 1, 2, 5, 6 and 7 of the invention as well as Samples 8, 9 and 10 of the conventional alloys were subjected to the measurement of tensile strength at elevated temperature. These Samples of invention and conventional alloys were heated to 150° C and 250° C, over the period of 100 hours, and then tested for their tensile strength at said temperatures. FIG. 7 illustrates dependence of tensile strength in Kg/mm² upon the testing temperature in ° C, wherein the reference numerals indicate the corresponding numerals of the Samples. As is clear from FIG. 7, the specimens of the invention have tensile strengths at elevated temperatures higher than the conventional alloys.

The following example 2 is presented to illustrate the machinability of the proposed alloys.

EXAMPLE 2

Figure 8:
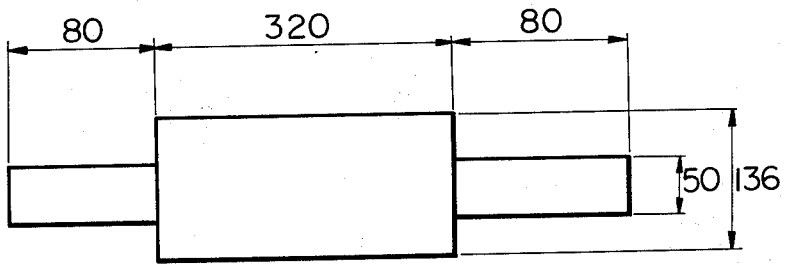

The process of Example 2 was repeated except that the melt was poured into a metallic mold shaped as shown in FIG. 8. The chemical compositions of the alloys were as shown in Table IV, below.

Table IV

| Sample No. | Composition of Alloy | | | | | | | | |
|---|---|---|---|---|---|---|---|---|---|
| | Si | Cu | Mg | Mn | Ti | Zn | Pb | Fe | Al |
| 1 | 19 | 4.5 | 0.5 | 0.5 | 0.15 | — | — | 0.25 | bal |
| 2 | 19 | 4.5 | 0.5 | 0.5 | 0.15 | 0.8 | — | 0.3 | bal |
| 3 | 19 | 4.5 | 0.5 | 0.5 | 0.15 | — | 1.2 | 0.3 | bal |

The casting was then machined using a high speed lathe. The machining conditions were as follows:

-continued

| | |
|---|---|
| Tool: | Tip-type tool, Point of Tip had the shape of 5R; |
| Grain depth of cut: | 1.5 mm; |
| Feed: | 0.3 mm/rev; |
| Cutting speed: | 600 m/min; |
| Condition of Cutting: | Dry; |
| Length of cutting: | 30 m. |

The results were as shown in Table V, below.

Table V

| Sample No. | Evaluation of Machinability — Elements of Machinability | | | | | | | |
|---|---|---|---|---|---|---|---|---|
| | Wear in Width of Tool (× 100mm) | Length of Adhesive Formed on Flank (mm) | Occurrence of Chutter (times) | Occurence of tool Stop by Blockade of chip (times) | Roughness of Finished Surface *1 | Shape of Chip *2 | Main Component of Cutting Force (Kg) | Total |
| 1 | 150 | 25.8 | 10 | 7 | 13.0 | 7.0 | 7.0 | 215.8 |
| 2 | 88 | 23.2 | 6 | 1 | 9.0 | 6.3 | 6.3 | 134.5 |
| 3 | 80 | 15.5 | 5 | 0 | 7.0 | 5.9 | 5.9 | 113.4 |

Remarks:
*1 : Degree of surface finish was expressed numerically in terms of the deviation of the obtained roughness from the desired roughness as well as the uniformity of pattern marked by the tool.
*2 : Shape of Chip was expressed numerically so that the better the shape the smaller the number.

In the Table V, the machinability is better with lesser total values. As is clear from Table V, alloys containing zinc or lead exhibit excellent machinability.

What we claim is:

1. A hyper-eutectic aluminum-silicon based, high strength alloy for castings, consisting essentially of 16 to 25% of silicon, 3.0 to 5.5% of copper, 0.2 to 0.8% of magnesium, 0.3 to 0.8% of manganese, not more than 0.25% of titanium, and not more than 0.3% of iron, the balance being aluminum.

2. An alloy according to claim 1, wherein said alloy consists essentially of 16 to 19% of silicon, 4.0 to 5.0% of copper, 0.3 to 0.5% of magnesium, 0.3 to 0.5% of manganese and not more than 0.25% of titanium, the balance being aluminum.

3. A hyper-eutectic aluminum-silicon based, high strength alloy for castings, consisting essentially of 16 to 25% of silicon, 3.0 to 5.5% of copper, 0.2 to 0.8% of magnesium, 0.3 to 0.8% of manganese, 0.5 to 1.5% of Zinc not more than 0.25% of titanium, and not more than 0.3% of iron, the balance being aluminum.

4. An alloy according to claim 3, wherein said alloy consists essentially of 16 to 19% of silicon, 4.0 to 5.0% of copper, 0.3 to 0.5% of magnesium, 0.3 to 0.5% of manganese, not more than 0.25% of titanium and 0.5 to 1% of zinc, the balance being aluminum.

5. A hyper-eutectic aluminum-silicon based, high strength alloy for castings, consisting essentially of 16 to 25% of silicon, 3.0 to 5.5% of copper, 0.2 to 0.8% of magnesium, 0.3 to 0.8% of manganese, 0.3 to 2.0% of lead not more than 0.25% of titanium, and not more than 0.3% of iron the balance being aluminum.

6. An alloy according to claim 5, wherein said alloy consists essentially of 16 to 19% of silicon, 4.0 to 5.0% of copper, 0.3 to 0.5% of magnesium, 0.3 to 0.5% of manganese, not more than 0.25% of titanium, 0.7 to 1.2% of lead, the balance being essentially aluminum.

* * * * *